US007510519B2

(12) United States Patent
Reichenbach et al.

(10) Patent No.: US 7,510,519 B2
(45) Date of Patent: Mar. 31, 2009

(54) SOLID BOWL SCREW CENTRIFUGE COMPRISING A CENTRIPETAL PUMP WITH A THROTTING DEVICE

(75) Inventors: Michael Reichenbach, Köln (DE); Michael Müller, Dinslaken (DE)

(73) Assignee: Westfalia Separator AG, Oelde (DE)

( * ) Notice: Subject to any disclaimer, the term of this patent is extended or adjusted under 35 U.S.C. 154(b) by 373 days.

(21) Appl. No.: 10/567,487

(22) PCT Filed: Jul. 30, 2004

(86) PCT No.: PCT/EP2004/008575

§ 371 (c)(1),
(2), (4) Date: Feb. 7, 2006

(87) PCT Pub. No.: WO2005/016544

PCT Pub. Date: Feb. 24, 2005

(65) Prior Publication Data

US 2008/0153687 A1 Jun. 26, 2008

(30) Foreign Application Priority Data

Aug. 8, 2003 (DE) ..... 103 36 350

(51) Int. Cl.
*B04B 11/08* (2006.01)
*B04B 1/20* (2006.01)

(52) U.S. Cl. ..... 494/57; 494/53

(58) Field of Classification Search ..... 494/23–30, 494/37, 50–57; 210/380.1, 380.3
See application file for complete search history.

(56) References Cited

U.S. PATENT DOCUMENTS

| | | | | | |
|---|---|---|---|---|---|
| 3,279,687 | A | * | 10/1966 | Amero | 494/37 |
| 3,279,688 | A | * | 10/1966 | Cook | 494/10 |
| 3,321,131 | A | * | 5/1967 | Cook | 494/10 |
| 3,447,742 | A | * | 6/1969 | Eriksson et al. | 494/53 |
| 3,784,091 | A | * | 1/1974 | Hiller | 494/27 |
| 3,795,361 | A | * | 3/1974 | Lee | 494/26 |
| 3,968,929 | A | * | 7/1976 | Olesen | 494/22 |
| 4,042,172 | A | | 8/1977 | Nozdrovsky | |
| 4,334,647 | A | * | 6/1982 | Taylor | 494/37 |
| 4,406,652 | A | * | 9/1983 | Nielsen | 494/56 |
| 4,451,247 | A | * | 5/1984 | Ostkamp et al. | 494/52 |
| 4,464,162 | A | * | 8/1984 | Cummings | 494/53 |
| 4,525,155 | A | | 6/1985 | Nilsson | |

(Continued)

FOREIGN PATENT DOCUMENTS

CA 30 14 315 10/1981

(Continued)

*Primary Examiner*—Charles E Cooley
(74) *Attorney, Agent, or Firm*—Barnes & Thornburg LLP

(57) ABSTRACT

A solid bowl screw centrifuge including: a drum having a solids discharge at a conical end and at least one discharge opening at an end opposite the conical end, the at least one discharge opening arranged with an axial drum lid; a screw rotatable at a different speed relative to the drum; a centripetal chamber section connected behind the drum lid with the at least one discharge opening; a centripetal pump arranged to discharge a liquid phase from the solid bowl screw centrifuge; and an adjustable throttling device connected in front of the centripetal pump in the centripetal chamber section, the adjustable throttling device being assigned to the at least one discharge opening.

12 Claims, 4 Drawing Sheets

U.S. PATENT DOCUMENTS

| | | | | | |
|---|---|---|---|---|---|
| 4,566,873 | A | * | 1/1986 | Toda | 494/53 |
| 4,615,690 | A | * | 10/1986 | Ecker | 494/56 |
| 4,898,571 | A | * | 2/1990 | Epper et al. | 494/26 |
| 5,171,205 | A | * | 12/1992 | Monkenbusch | 494/10 |
| 5,217,428 | A | * | 6/1993 | Schlip et al. | 494/56 |
| 5,542,903 | A | * | 8/1996 | Nishida et al. | 494/53 |
| 5,593,377 | A | * | 1/1997 | Figgener et al. | 494/56 |
| 5,643,169 | A | | 7/1997 | Leung et al. | |
| 5,685,819 | A | * | 11/1997 | Nishida et al. | 494/53 |
| 5,695,442 | A | | 12/1997 | Leung et al. | |
| 5,800,332 | A | * | 9/1998 | Hensley | 494/53 |
| 5,885,202 | A | * | 3/1999 | Ostkamp | 494/25 |
| 6,572,524 | B1 | * | 6/2003 | Caldwell | 494/53 |
| 6,749,552 | B1 | * | 6/2004 | Figgener et al. | 494/53 |
| 6,986,733 | B2 | * | 1/2006 | Beyer et al. | 494/41 |
| 7,056,273 | B2 | * | 6/2006 | Ostkamp et al. | 494/27 |
| 7,083,565 | B2 | * | 8/2006 | Hermeler et al. | 494/53 |
| 7,255,670 | B2 | * | 8/2007 | Hensley et al. | 494/10 |
| 7,326,169 | B2 | | 2/2008 | Brüning et al. | |
| 2004/0185999 | A1 | * | 9/2004 | Beyer et al. | 494/53 |
| 2005/0164861 | A1 | | 7/2005 | Bruning et al. | |
| 2005/0197241 | A1 | * | 9/2005 | Hensley et al. | 494/57 |
| 2005/0202950 | A1 | * | 9/2005 | Dircks et al. | 494/54 |
| 2005/0227848 | A1 | * | 10/2005 | Ostkamp et al. | 494/53 |
| 2006/0142137 | A1 | * | 6/2006 | Hermeler et al. | 494/53 |
| 2006/0183621 | A1 | * | 8/2006 | Beyer | 494/53 |
| 2008/0153687 | A1 | * | 6/2008 | Reichenbach et al. | |

FOREIGN PATENT DOCUMENTS

| | | | | |
|---|---|---|---|---|
| CA | 1 180 195 | | | 1/1985 |
| DE | 1 220 012 | | | 6/1966 |
| DE | 2246113 | A | * | 5/1973 |
| DE | 37 28 901 | C1 | | 11/1988 |
| DE | 3728901 | C1 | * | 11/1988 |
| DE | 38 22 983 | A1 | | 1/1990 |
| DE | 3822983 | A1 | * | 1/1990 |
| DE | 3833523 | A1 | * | 4/1990 |
| DE | 4132044 | C1 | * | 11/1992 |
| DE | 41 32 029 | A1 | | 4/1993 |
| DE | 4339582 | C1 | * | 5/1995 |
| DE | 4403912 | A1 | * | 8/1995 |
| DE | 19516636 | A1 | * | 2/1996 |
| DE | 102 09 925 | A1 | | 9/2003 |
| EP | 640398 | A2 | * | 3/1995 |
| EP | 1 044 723 | A1 | | 10/2000 |
| GB | 1 569 520 | | | 6/1980 |
| JP | 58199055 | A | * | 11/1983 |
| JP | 02071859 | A | * | 3/1990 |
| JP | 04222651 | A | * | 8/1992 |
| WO | WO 86/01436 | | | 3/1986 |
| WO | WO 96/34693 | | | 11/1996 |
| WO | WO 02/05966 | A2 | | 1/2002 |
| WO | WO 02/062483 | A1 | | 8/2002 |
| WO | WO 03099446 | A1 | * | 12/2003 |
| WO | WO 2006/096113 | A1 | | 9/2006 |
| WO | WO 2006133804 | A1 | * | 12/2006 |
| WO | WO 2007113113 | A1 | * | 10/2007 |

* cited by examiner 13
17
3b
34
32
11

SOLID BOWL SCREW CENTRIFUGE COMPRISING A CENTRIPETAL PUMP WITH A THROTTING DEVICE

BACKGROUND AND SUMMARY

The present disclosure relates to a solid bowl screw centrifuge including: a drum having a solids discharge at a conical end and at least one discharge opening at an end opposite the conical end, the at least one discharge opening arranged with an axial drum lid; a screw rotatable at a different speed relative to the drum; a centripetal chamber section connected behind the drum lid with the at least one discharge opening; and a centripetal pump arranged to discharge a liquid phase from the solid bowl screw centrifuge.

Centrifuges having one or more centripetal pump(s) as a liquid discharge are known from the field of separators as well as from the field of solid bowl screw centrifuges.

It is also known to discharge a liquid phase, particularly under pressure, from solid bowl screw centrifuges by means of centripetal pumps. In these cases, a baffle plate is generally arranged on the screw in the transition to the conical area or at another suitable point. For adjusting the conditions in the centrifuge, particularly the liquid level, the centripetal pump is appropriately throttled. This has considerable effects on the entire process and thus on the centrifuge as well as possible surrounding components or components on the output side. The adjusting of solid bowl screw centrifuges therefore requires relatively high expenditures and can only take place to a limited extent during the operation.

The present disclosure relates to improving the operation and the adjustability of solid bowl screw centrifuges which have a centripetal pump as the liquid discharge.

Thus, the present disclosure relates to a solid bowl screw centrifuge that includes: a solid bowl screw centrifuge comprising: a drum having a solids discharge at a conical end and at least one discharge opening at an end opposite the conical end, the at least one discharge opening arranged with an axial drum lid; a screw rotatable at a different speed relative to the drum; a centripetal chamber section connected behind the drum lid with the at least one discharge opening; a centripetal pump arranged to discharge a liquid phase from the solid bowl screw centrifuge; and an adjustable throttling device connected in front of the centripetal pump in the centripetal chamber section, the adjustable throttling device being assigned to the at least one discharge opening.

Accordingly, the throttling device which, in an operation during rotations of the drum, is continuously adjustable, and may be connected in front of the centripetal pump in the centripetal chamber section. The throttling device is assigned to or connected behind the at least one discharge opening, which additionally may be equipped with an overflow disk. This throttling device makes it possible to influence the liquid level in the drum of the centrifuge in addition to the operation of a baffle plate by throttling the liquid outlet cross-section. Thus, by changing the flow resistance between the overflows from the drum and the throttling device in front of the centripetal pump or the gripper, this surprisingly clearly optimizes the possibility of controlling and/or regulating the conditions in the centrifuge.

When centripetal pumps are used, which already permit a certain control of the liquid level in the centrifuge, an additional throttling device in front of the centripetal pump so far had not been considered. However, as recognized in the present disclosure, this additional throttling device results in special advantages when controlling and/or regulating the liquid level in the drum.

According to an embodiment of the present disclosure, the throttling device may be constructed as an element which is stationary during the operation. However, as an alternative, it may be constructed as an element which rotates during the operation together with the drum.

According to an embodiment of the present disclosure, the throttling device has at least one or more movable disk elements, slide elements and/or pneumatically or hydraulically operable bellows or membrane elements which are assigned to the individual discharge openings and can more or less open up or close the latter.

In such a case, the throttling device is constructed as a movable throttle disk arranged in the centripetal chamber section and situated behind the discharge openings and in front of the centripetal pump. A baffle plate may also be arranged on the screw.

From German Patent Document DE 39 21 327 A1, it is known to form a weir of adjusting elements, such as pressure bellows and the like. A throttling device could also be implemented with such pressure bellows. However, the constructively simple and easily adjustable throttle disk is in a further development in which it does not co-rotate.

When using solid bowl screw centrifuges having a centripetal pump, it is advantageous to use the additional throttling device for influencing the liquid level in the centrifuge. Although European Patent Document EP 0 702 599 B1 already discloses the assigning of an axially displaceable throttle disk to an overflow-type passage in a drum lid outside a centrifugal drum on the exterior side of the drum, which throttle disk is constructed as a part which is stationary during the operation and is constructed to be axially movable, particularly axially slidable, relative to the overflow weir, by means of the stationary throttle disk, a flow resistance is generated in the weir which is greater the smaller the axial distance between the weir and the throttle disk. As the flow resistance increases, a higher liquid pressure is required at the passage, which results in a rise of the liquid level in the centrifugal drum. If the axial distance between the weir and the throttle disk is enlarged, the liquid level in the centrifugal drum will decrease to a value which is caused essentially only by the passage of the weir or the discharge openings. However, the use of the throttle disk in the case of a centrifuge having a centripetal pump was not considered in this document because centripetal pumps already permit a certain regulating of the liquid level in the drum. This regulating takes place by way of the adjusting of a valve in the discharge line, which valve influences the regulating of the liquid level by way of corresponding counterpressure.

It is surprisingly advantageous to combine the centripetal pump with a movable, particularly axially adjustable throttle disk in the drum because it thereby becomes possible, when a centripetal pump is used, to continuously regulate the pool depth during the operation and thus adjust the optimal ratio between the flow in the centripetal chamber section and the pool depth in the decanter drum without having to throttle the discharge line.

In the present disclosure, the throttle disk, even in the non-rotating embodiment, surprisingly is arranged differently than in the state of the art in the drum in a very different manner than in the case of the throttle disk of European Patent Document EP 0 702 599 B 1.

With respect to the state of the art, German Patent Document DE 37 28 901 C1 discloses a swirl flow space constructed in a weir disk, which is arranged at the passage openings, the axis of symmetry of the swirl flow space extending parallel to and at a radial distance from the axis of rotation of the drum, and its feeding pipe having a larger radial distance from the axis of rotation of the centrifuge drum than the discharge duct. In this manner, an operation is achieved at two liquid levels but an adjustability does not exist during the operation.

In the case of pulp, which is difficult to discharge, a hydraulic support is often required during the discharge by a $\Delta p$ in front of and behind a baffle plate on the screw. If the regulating diameter at the liquid discharge is rigidly adjusted to this value, penetrations of liquid can be expected on the solids side during the starting process because no sufficient solids closure has yet formed at the baffle plate. Inversely, the maximal pool depth/clarifying effect cannot be achieved when the adjustment of the regulating diameter is large. According to the present disclosure, by a combination of the throttle disk and the centripetal pump, an operation "with a shallow pool" can take place in a simple manner in the starting condition until a sufficient bed formation or solids closure has taken place at the baffle plate in order to then increase the pool depth to the maximally possible value. The present disclosure, therefore, makes it possible to satisfactorily process also pulp by a centripetal pump, which pulp is difficult to discharge.

Thus, the non-rotating centripetal pump is no longer throttled for the adjustment but, after its one-time suitable adjustment, a regulating of the conditions in the drum also becomes possible during the operation.

The non-rotating, axially movable throttle disk in combination with the centripetal pump and a baffle plate on the screw is also advantageous particularly when starting the solid bowl screw centrifuge. This advantage was not recognized according to the state of the art.

Furthermore, there is often the requirement that it should be possible to influence the pool depth, or the depth of the liquid level, during the operation in order to be able to compensate fluctuations in the inlet and in the product quality and thereby operate the decanter at the optimal operating point in time (efficiency). In the case of decanters having a centripetal pump, this had previously only be possible by throttling the discharge line.

The throttle disk may be constructed as a part which is stationary during the operation or rotates along. For the reasons described in European Patent Document EP 0 702 599 B 1, the construction as a stationary part may be preferred.

The throttle disk can easily be constructed to be stationary during the operation if it can be moved by a connecting rod which penetrates a stationary feeding pipe not rotatable during the operation or a component connected with the feeding pipe. In this case, the throttle disk is displaceably guided on the feeding pipe and/or the centripetal pump.

Other aspects of the present disclosure will become apparent from the following descriptions when considered in conjunction with the accompanying drawings.

DETAILED DESCRIPTION

Figure 1:
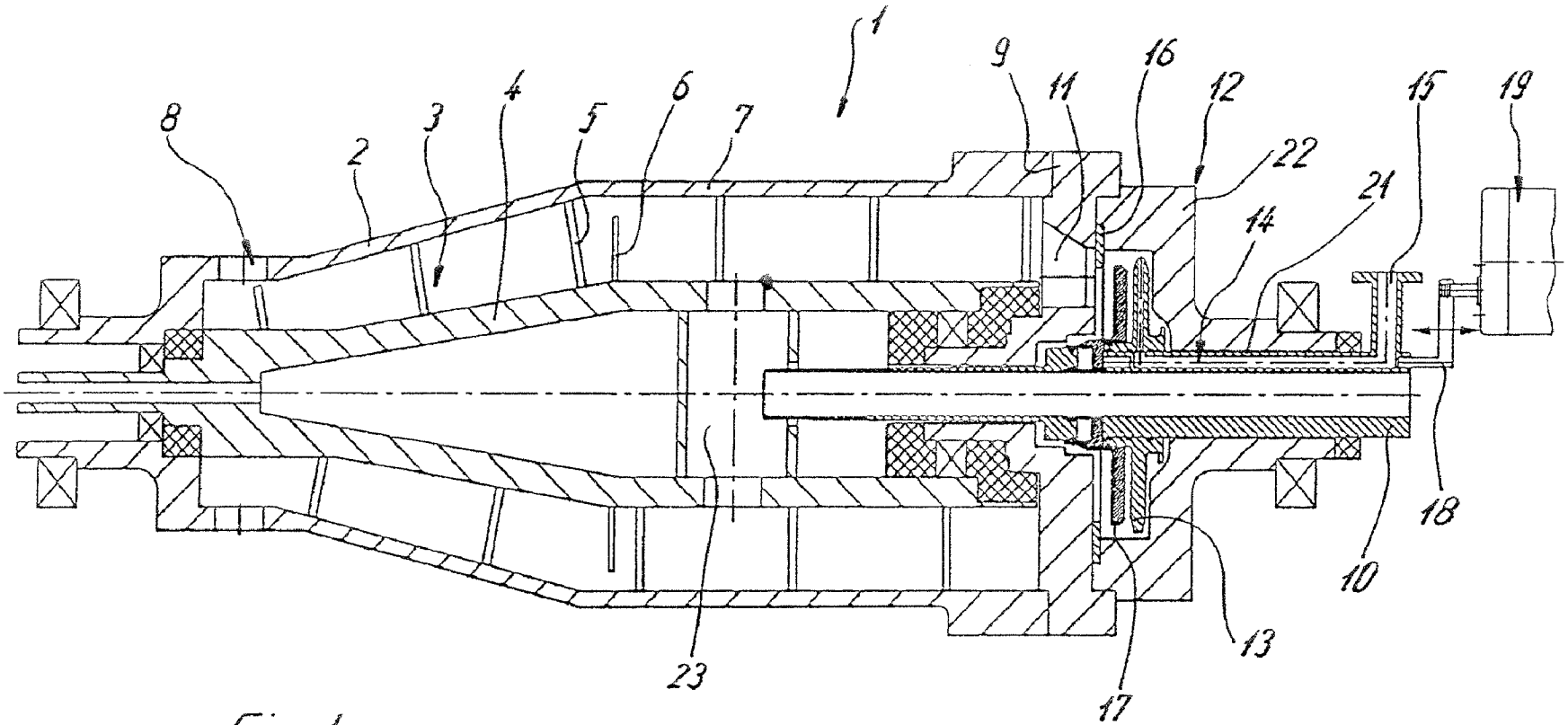
FIG. 1 is a sectional view of a drum of a solid bowl screw centrifuge, according to the present disclosure.

FIG. 1 is a sectional view of a solid bowl screw centrifuge 1 having a rotatable drum 2 and a rotatable screw 3. The drum 2 and the screw 3 have a differential rotational speed relative to one another during an operation. That is, drum 2 and screw 3 rotate relative to one another.

The screw 3 has an interior screw body 4 as well as an exterior screw blade 5. The screw 3 conically tapers at one of its ends, in an area of a transition to a conical area of the screw 3. A baffle plate 6 is arranged on the screw 3.

The drum 2 has a shell 7, which tapers conically at one of the ends of the drum 2, at which end a solids discharge 8 is constructed.

At a second end facing away from the conically tapered end, the drum 2 is axially closed by a drum lid 9. On an interior circumference, the drum lid 9 is penetrated by a feeding pipe 10 for the feeding of centrifugal material by a distributor 23 into the drum 2. The feeding pipe 10 is stationary relative to the drum 2 in an operation when the drum 2 is rotating.

A centripetal chamber section 12 is connected behind the drum lid 9 having overflow-type discharge openings 11 whose inside radius is bounded by a ring disk 16 attached to the lid 9. The centripetal chamber section 12 is non-rotatably connected with the drum lid 9.

The centripetal chamber section 12 includes a stepped ring attachment 22 which bounds the centripetal chamber section 12 connected behind the drum 2 to the outside, and in which a centripetal pump 13 for discharging a liquid phase is connected on an output side. The ring attachment 22 is penetrated by the feeding pipe 10 and by a shaft attachment 21 of the centripetal pump 13. The shaft attachment may be combined with the feeding pipe 10. The centripetal pump 13 is also arranged in a stationary or non-rotatable manner on the feeding pipe 10 and guides liquid through a discharge duct 14 in the shaft attachment 21 of the centripetal pump 13 to an outlet 15.

Between the centripetal pump 13 and the discharge openings 11 is a ring disk 16. A throttling device, or throttle disk 17, is arranged in the centripetal chamber section 12, and an outer circumference of the throttle disk 17 may be larger than or equal to an inner circumference of the discharge openings 11.

The throttle disk 17 is axially movable, that is, for example, axially slidable or swivellable, and arranged relative to the drum 2, so that a distance between the throttle disk 17 and the discharge openings 11 can be completely or partially changed. The throttle disk 17 is slidably arranged on the feeding pipe 10 so that it can be moved, for example, by at least one connecting rod 18 which penetrates the shaft attachment 21 of the throttle disk 13. For example, an electric drive 19, for moving the at least one connecting rod 18 and for displacing the throttle disk 17, is applied to an end of the connecting rod 18 facing away from the throttle disk 17.

The throttle disk 17 (see FIG. 2*b*) includes an outer throttle disk section 20, a pipe-type center section 24 and a inner ring section 25 arranged to be axially offset with respect to the throttle disk section 20. The pipe-type section 24 is guided in a sealed-off and displaceable manner on ring attachments 26 of the feeding pipe 10 and a ring attachment 27 of the throttle disk.

By the arrangement of FIG. 1, it becomes possible to continuously regulate a pool depth 34 (see shaded areas in FIGS. 2*a*-3*b*) in the drum 2 and to adjust an optimal ratio between a flow into the centripetal chamber section 12 and the pool depth 34 in the drum 2. In this manner, positive effects can be achieved. The throttle disk 17 can be moved between the centripetal pump 13 and the discharge openings 11.

Figure 2B:
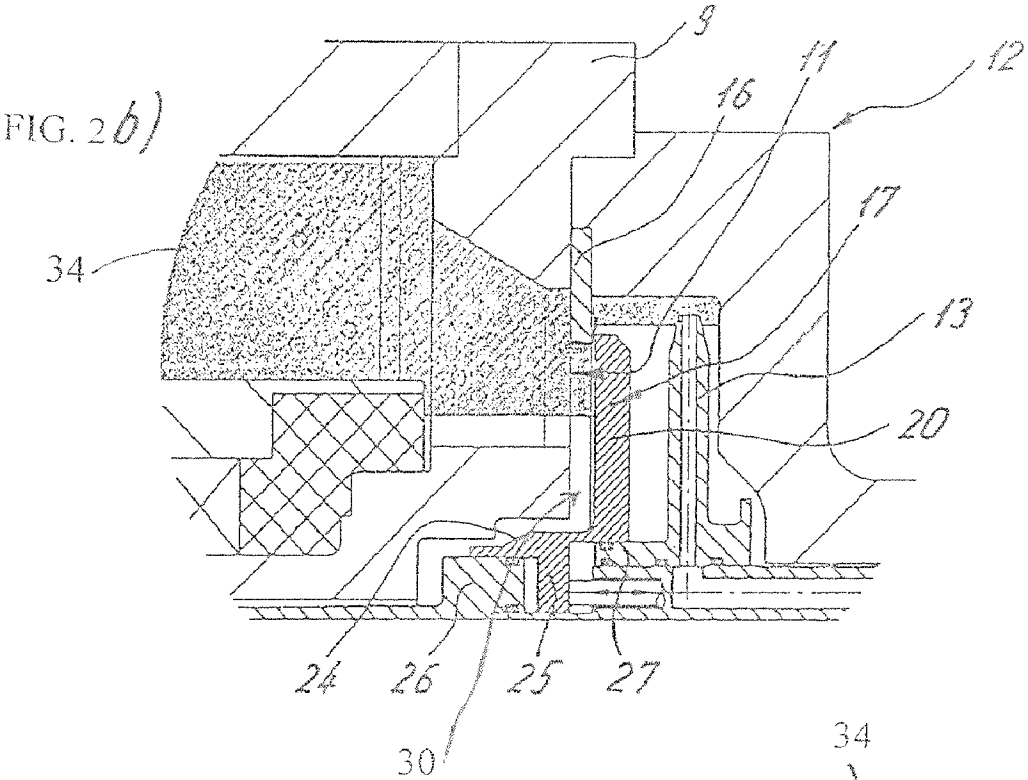
FIG. 2*b* is a view of an enlargement of a cutout designated as 2*b* in FIG. 2*a*.
Figure 2A:
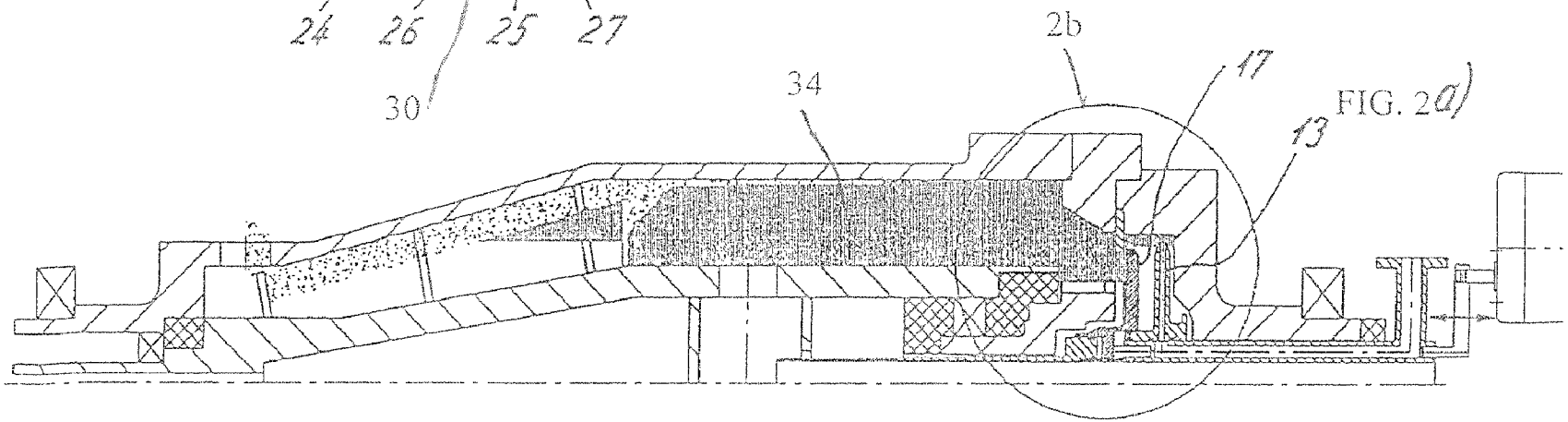
FIG. 2*a* is a sectional view of the solid bowl screw centrifuge of FIG. 1 in a first operating condition.
Figures 3, 3A, 3B:
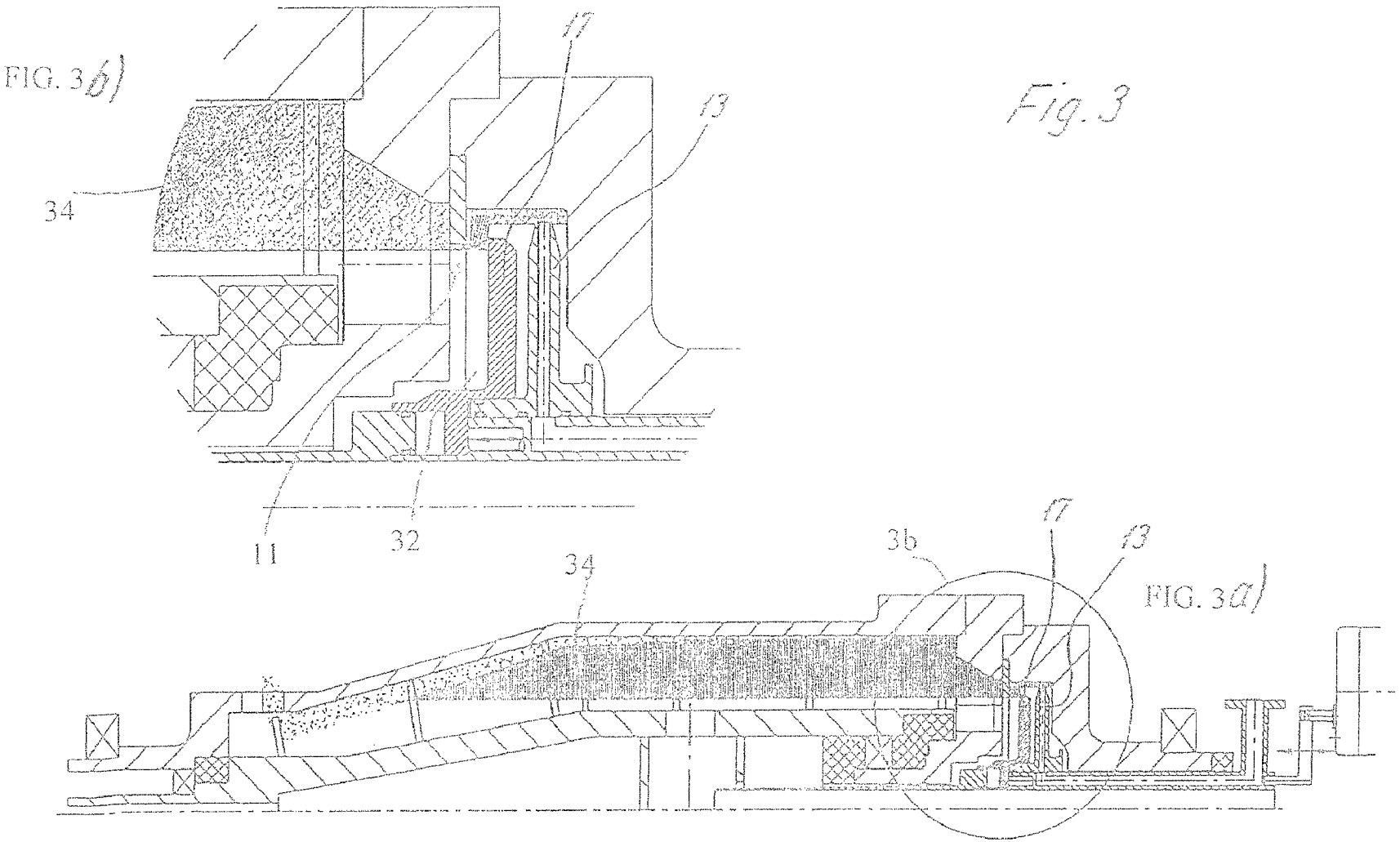
FIG. 3*a* is a sectional view of the solid bowl screw centrifuge of FIG. 1 in a second operating condition.
FIG. 3*b* is a view of an enlargement of cutout designated as 3*b* in FIG. 3*a*.

FIG. 2*b* shows a relatively narrow gap 30 and FIG. 3*b* shows a relatively large gap 32 between the throttle disk 17 and discharge openings 11. FIGS. 2*a*, 2*b*, 3*a* and 3*b* shows an effect of the throttle disk 17. An actual discharge takes place by the centripetal pump 13. Whereas, by the throttle disk 17, the discharge quantity and the pool depth 34 in the drum 2 can be regulated. A combination of the centripetal pump 13, the throttle disk 17 and the baffle plate 6 on the screw 3 interacts with the throttle disk 17 and permits an adjustment of conditions. Thus, for example, by the throttle disk 17, a condition with a so-called shallow pool, that is, with a low pool depth, can be used in an operation until a sufficient bed formation of solids has taken place in the drum 2 in order to then increase the pool depth 34 to a maximum possible value. Thus, not only an overflow level is adjusted by the throttling disk 17 but the pool depth 34 is also influenced by throttling the discharge.

Figure 4:
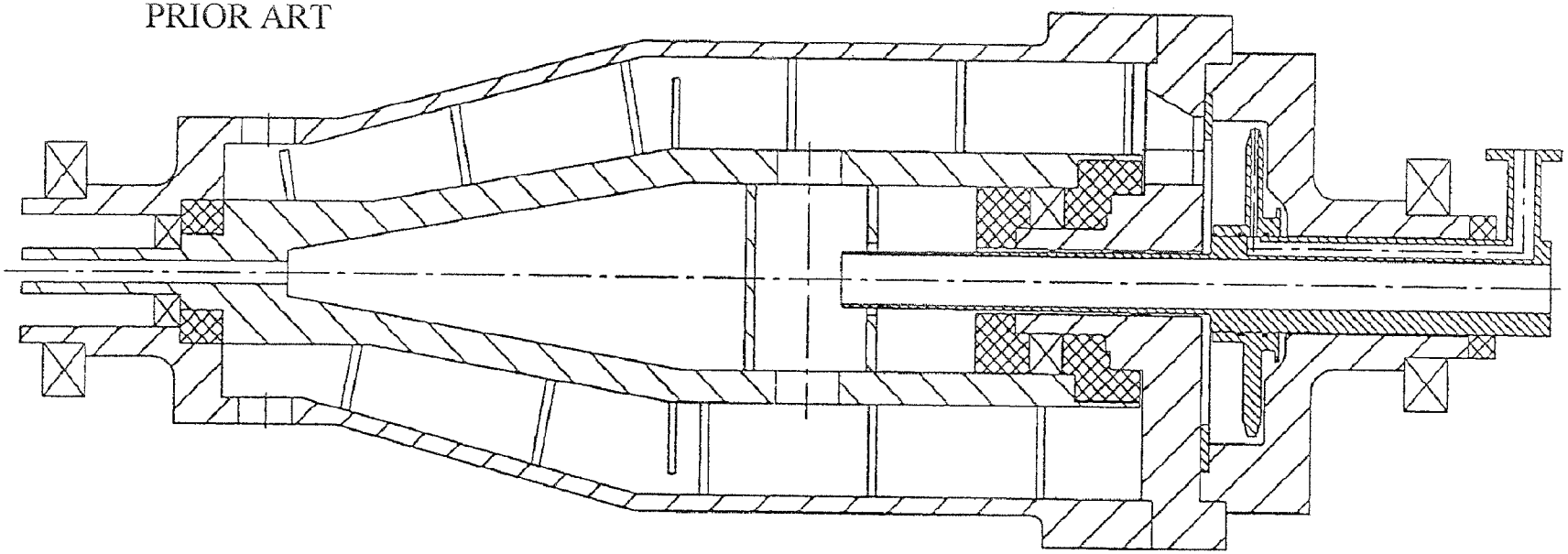
Fig. 4 PRIOR ART
FIG. 4 is a sectional view of a drum of a solid bowl screw centrifuge according to the prior art.

FIG. 4 shows a solid bowl screw centrifuge according to the state of the art, where no throttle disk 17 is arranged in the centripetal chamber section.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A solid bowl screw centrifuge comprising:

a drum having a solids discharge at a conical end and at least one discharge opening at an end opposite the conical end, the at least one discharge opening arranged with an axial drum lid;

a screw rotatable at a different speed relative to the drum;

a centripetal chamber section connected behind the drum lid with the at least one discharge opening;

a centripetal pump arranged to discharge a liquid phase from the solid bowl screw centrifuge;

an adjustable throttling device connected in front of the centripetal pump in the centripetal chamber section, the adjustable throttling device being assigned to the at least one discharge opening;

wherein the throttling device is constructed as a throttle disk arranged in the centripetal chamber section, connected behind the at least one discharge opening and connected in front of the centripetal pump; and wherein the throttle disk is axially adjacent the centripetal pump and is axially movable in the centripetal chamber to cooperate with a surface of the centripetal chamber to adjust an amount of flow out of the discharge opening.

2. The solid bowl screw centrifuge according to claim 1, wherein the throttle disk is adjustable during an operation as the drum is rotating.

3. The solid bowl screw centrifuge according to claim 1, wherein the throttle disk permits a continuous adjusting of a pool depth.

4. The solid bowl screw centrifuge according to claim 1, wherein a baffle plate is arranged on the screw.

5. The solid bowl screw centrifuge according to claim 1, wherein the throttle disk is constructed as an element which is stationary during an operation.

6. The solid bowl screw centrifuge according to claim 1, wherein the throttle disk is constructed as an element which rotates during an operation with the drum.

7. The solid bowl screw centrifuge according to claim 1, wherein the throttle disk has a swivellable construction.

8. The solid bowl screw centrifuge according to claim 1, wherein the throttle disk is movable between the centripetal pump and the at least one discharge opening.

9. The solid bowl screw centrifuge of claim 1, wherein the surface of the centripetal chamber is a ring disk located in front of the throttle disk.

10. A solid bowl screw centrifuge comprising:

a drum having a solids discharge at a conical end and at least one discharge opening at an end opposite the conical end, the at least one discharge opening arranged with an axial drum lid;

a screw rotatable at a different speed relative to the drum;

a centripetal chamber section connected behind the drum lid with the at least one discharge opening;

a centripetal pump arranged to discharge a liquid phase from the solid bowl screw centrifuge;

an adjustable throttling device connected in front of the centripetal pump in the centripetal chamber section, the adjustable throttling device being assigned to the at least one discharge opening;

wherein the throttling device is constructed as a throttle disk arranged in the centripetal chamber section, connected behind the at least one discharge opening and connected in front of the centripetal pump; and wherein the throttle disk is movable by at least one connecting rod which is penetrated by a stationary feeding pipe which is non-rotatable during the operation.

11. A solid bowl screw centrifuge comprising:

a drum having a solids discharge at a conical end and at least one discharge opening at an end opposite the conical end, the at least one discharge opening arranged with an axial drum lid;

a screw rotatable at a different speed relative to the drum;

a centripetal chamber section connected behind the drum lid with the at least one discharge opening;

a centripetal pump arranged to discharge a liquid phase from the solid bowl screw centrifuge;

an adjustable throttling device connected in front of the centripetal pump in the centripetal chamber section, the adjustable throttling device being assigned to the at least on discharge opening;

wherein the throttling device is constructed as a throttle disk arranged in the centripetal chamber section, connected behind the at least one discharge opening and connected in front of the centripetal pump; and wherein the throttle disk is displaceably guided on a feeding pipe.

12. A solid bowl screw centrifuge comprising:

a drum having a solids discharge at a conical end and at least one discharge opening at an end opposite the conical end, the at least one discharge opening arranged with an axial drum lid;

a screw rotatable at a different speed relative to the drum;

a centripetal chamber section connected behind the drum lid with the at least one discharge opening;

a centripetal pump arranged to discharge a liquid phase from the solid bowl screw centrifuge;

an adjustable throttling device connected in front of the centripetal pump in the centripetal chamber section, the adjustable throttling device being assigned to the at least one discharge opening;

wherein the throttling device is constructed as a throttle disk arranged in the centripetal chamber section, connected behind the at least one discharge opening and connected in front of the centripetal pump; and wherein the throttle disk is displacebly guided on the centripetal pump.

* * * * *